US005246410A

United States Patent [19]

Fun

[11] Patent Number: 5,246,410

[45] Date of Patent: Sep. 21, 1993

[54] GYMNASTIC PEDALING APPARATUS

[75] Inventor: Robert Fun, Nan-Tou City, Taiwan

[73] Assignee: Luxqueen Sporting Goods Mfg., Co., Nan-Tou City, Taiwan

[21] Appl. No.: 990,080

[22] Filed: Dec. 14, 1992

[51] Int. Cl.[5] ..... A63B 22/04

[52] U.S. Cl. ..... 482/53; 482/112

[58] Field of Search ..... 482/51-53, 482/57, 58, 63, 111, 112, 113

[56] References Cited

U.S. PATENT DOCUMENTS

| | | | |
|---|---|---|---|
| 4,254,950 | 3/1981 | Baumann | 482/112 |
| 5,039,087 | 8/1991 | Kuo | 482/52 |
| 5,183,448 | 2/1993 | Wang | 482/52 |

*Primary Examiner*—Stephen R. Crow

*Attorney, Agent, or Firm*—Browdy and Neimark

[57] ABSTRACT

A gymnastic pedaling apparatus comprises a base provided with a projected portion having a horizontally arranged pivot shaft on which two pedals are movably mounted. A damping adjusting device mounted on the base is composed of two bottom frames, an adjusting frame provided with two connecting rods and an adjusting theaded rod, a guide member pivoted with the adjusting frame, and a hydraulic cylinder having one end fastened to the base and another end fastened pivotally to the guide member. The damping of the gymnastic pedaling apparatus is effected when the two pedals are made to move upwards and downwards. Such upward and downward motions of the pedals trigger the rotation of the adjusting frame, which is subsequently forced to make an angular displacement so as to activate the piston rod of the hydraulic cylinder to effect a damping effect of a forward motion or a backward motion.

3 Claims, 3 Drawing Sheets

GYMNASTIC PEDALING APPARATUS

BACKGROUND OF THE INVENTION

The present invention relates to a gymnastic pedaling apparatus, which is ingeniously simple in structure and is practically handy.

As shown in FIG. 1, a gymnastic pedaling apparatus of the prior art comprises a frame 10, two pedal rods 12, two pedals 14, and two hydraulic cylinders 16. The two pedal rods 12 are respectively pivoted to the frame 10 in such a way that they can be moved upwards and downwards. Each of the two pedal rods 12 is provided with a long slot 13 and a rotary button 15. The two pedals 14 are respectively mounted on the free ends of the two pedal rods 12. Each of the two hydraulic cylinders 16 has an upper end that is fastened to the frame 10 and a lower end that is pivoted to the long slot 13 of the pedal rod 12 and is secured in place by means of the rotary button 15. The lower end of the hydraulic cylinder 16, which is pivoted to the long slot 13, is able to slide along the long slot 13 to a desired location where it is locked securely by the rotary button 15 which can be tightened by rotating. As a result, the damping of pedaling action can be so adjusted.

The prior art gymnastic pedaling apparatus described above has two major shortcomings, which are elucidated explicitly hereinafter.

The overall construction of the prior art gymnastic pedaling apparatus is so complicated as to make the structure of its frame 10 excessively cumbersome. In addition, the cost of the two hydraulic cylinders 16 designed for damping the pedaling action is excessively high. As a result, the overall cost of making the prior art gymnastic pedaling apparatus is relatively high.

The adjustment of the damping of the prior art gymnastic pedaling apparatus is attained by adjusting the pivoting positions of the two hydraulic cylinders 16. Such adjustment can not be done at such time when the apparatus is in operation. In addition, the adjustments of the damping of the two hydraulic cylinders 16 are carried out separately, thereby often resulting in a non-uniformity of the damping of the two hydraulic cylinders 16. In other words, the body-building effect of the apparatus is undermined, in view of the fact that the user of the apparatus would have to exert different magnitudes of force on the two pedals 14.

SUMMARY OF THE INVENTION

It is, therefore, the primary objective of the present invention to provide a gymnastic pedaling apparatus, which is simple in construction and can be made economically.

It is another objective of the present invention to provide a gymnastic pedaling apparatus, which comprises only one hydraulic cylinder intended for damping the pedaling action. In addition, the adjustment of the damping of the hydraulic cylinder can be done at such time when the apparatus is in operation.

It is still another objective of the present invention to provide a gymnastic pedaling apparatus, which affords the body-building effect on both feet as well as both hands.

In keeping with the principles of the present invention, the foregoing objectives of the present invention are attained by a gymnastic pedaling apparatus, which comprises a base, two pedals, a damping adjusting device, and two handles. The base is provided at the center of front portion thereof with a projected portion 21 having a horizontally arranged cylindrical body with an inner hole. Mounted respectively on both ends of the front portion is a U-shaped pivot lug. The rear portion of the base is provided at the center thereof with a U-shaped pivot lug. The middle portion of the base is provided with four fastening holes. Each of the two pedals is provided with a treading portion and a pivoting sleeve dimensioned to fit over the cylindrical body of the projected portion. The two pedals are further provided respectively with a round hole. The two round holes are opposite to each other. The damping adjusting device is mounted on the fastening holes of the base and is characterized in that it is composed of two bottom frames, an adjusting frame, two connecting rods, a guide member, an adjusting rod, and a hydraulic cylinder. Each of the two bottom frames has two circular holes which are corresponding in size and are located at the bottom surfaces of the frames. These circular holes are intended for use in fastening the bottom frames to the base. The vertical portion of each of the two bottom frames is provided with a through hole. The adjusting frame has a cylindrical body on which a hollow support body of a rectangular construction is mounted. The support body has two elongate slots which are opposite to each other and are located at two sides along the longitudinal axis of the support body. In addition, the support body has two round holes which are opposite to each other and are located at two sides along the short axis of the support body. The support body is fitted into the through hole of the bottom frame in a manner that the support body is able to rotate along the axis of the through hole. Each of the two connection rods has an upper connection rod and a lower connection rod having an end mounted vertically on one end of the cylindrical body of the support body and having another end that is pivoted to one end of the upper connection rod. Another end of the upper connection rod is pivotally mounted in the round hole of the pedal. The guide member of a cylindrical construction is fitted into the elongate slot of the support body and is provided with an inner threaded hole of the support body. The hydraulic cylinder has one end that is pivoted to both axial ends of the guide member and has another end that is pivoted to the U-shaped pivot lug of the base.

The foregoing objectives, structures, functions and features of the present invention will be better understood by studying the following detailed description of the invention, in conjunction with the drawings provided herewith.

DETAILED DESCRIPTION OF THE PREFERRED EMBODIMENT

Figure 1:
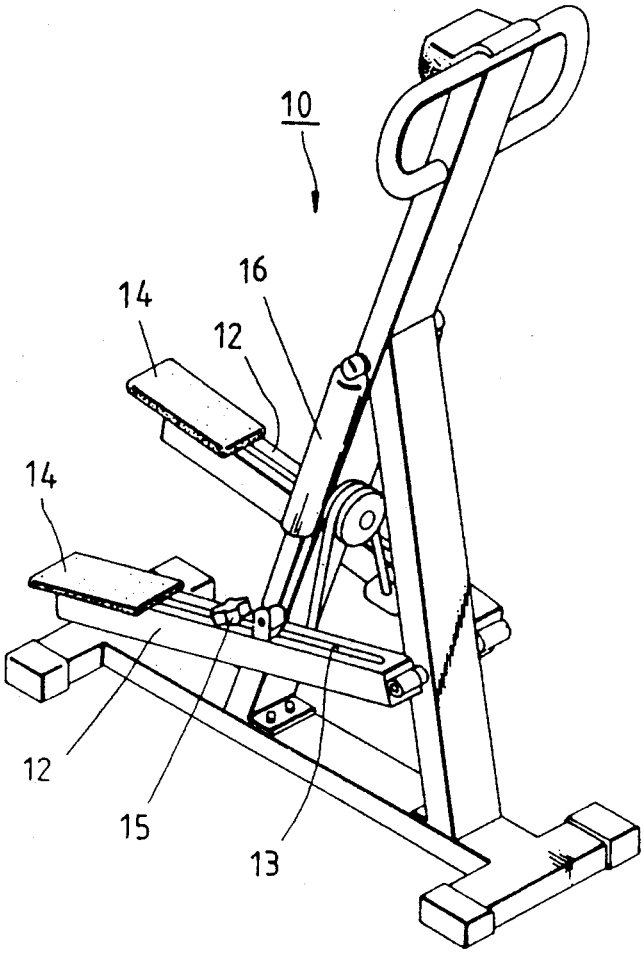
FIG. 1 PRIOR ART
FIG. 1 shows a perspective view of a gymnastic pedaling apparatus of the prior art.
Figure 4:
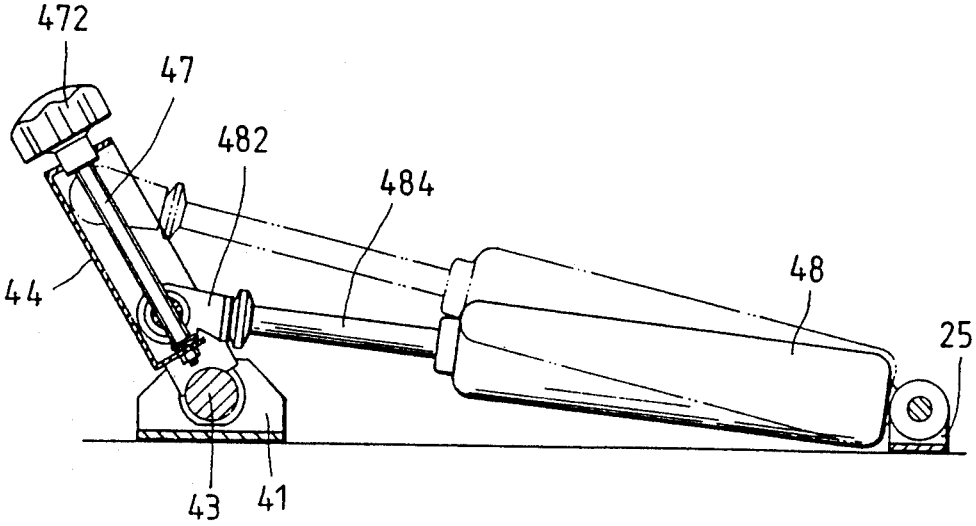
FIG. 4 is a plan schematic view of the present invention as shown in FIG. 3, illustrating the motion-transmitting state of the component parts of the present invention.
Figure 2:
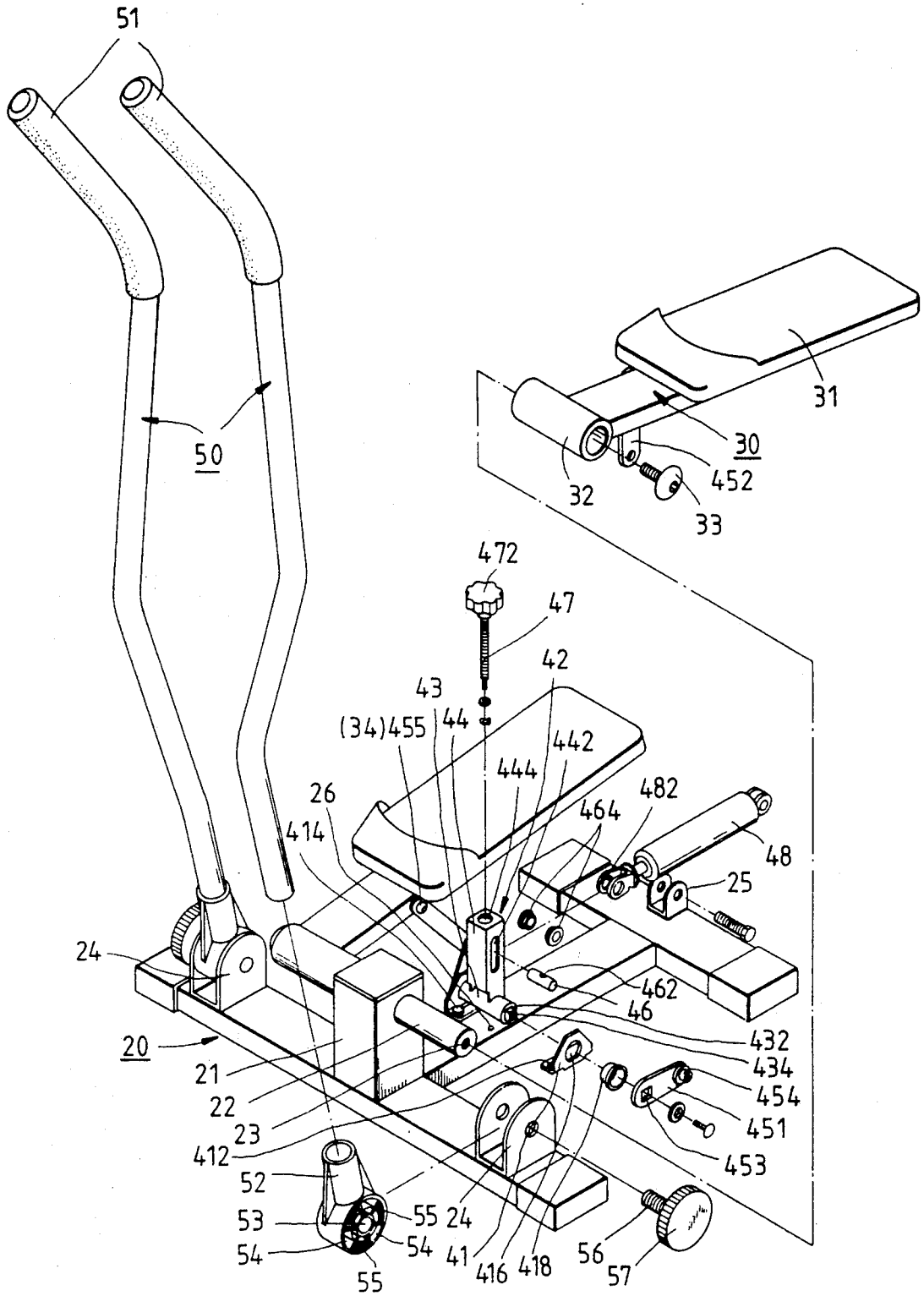
FIG. 2 shows a partial exploded view of the present invention.
Figure 3:
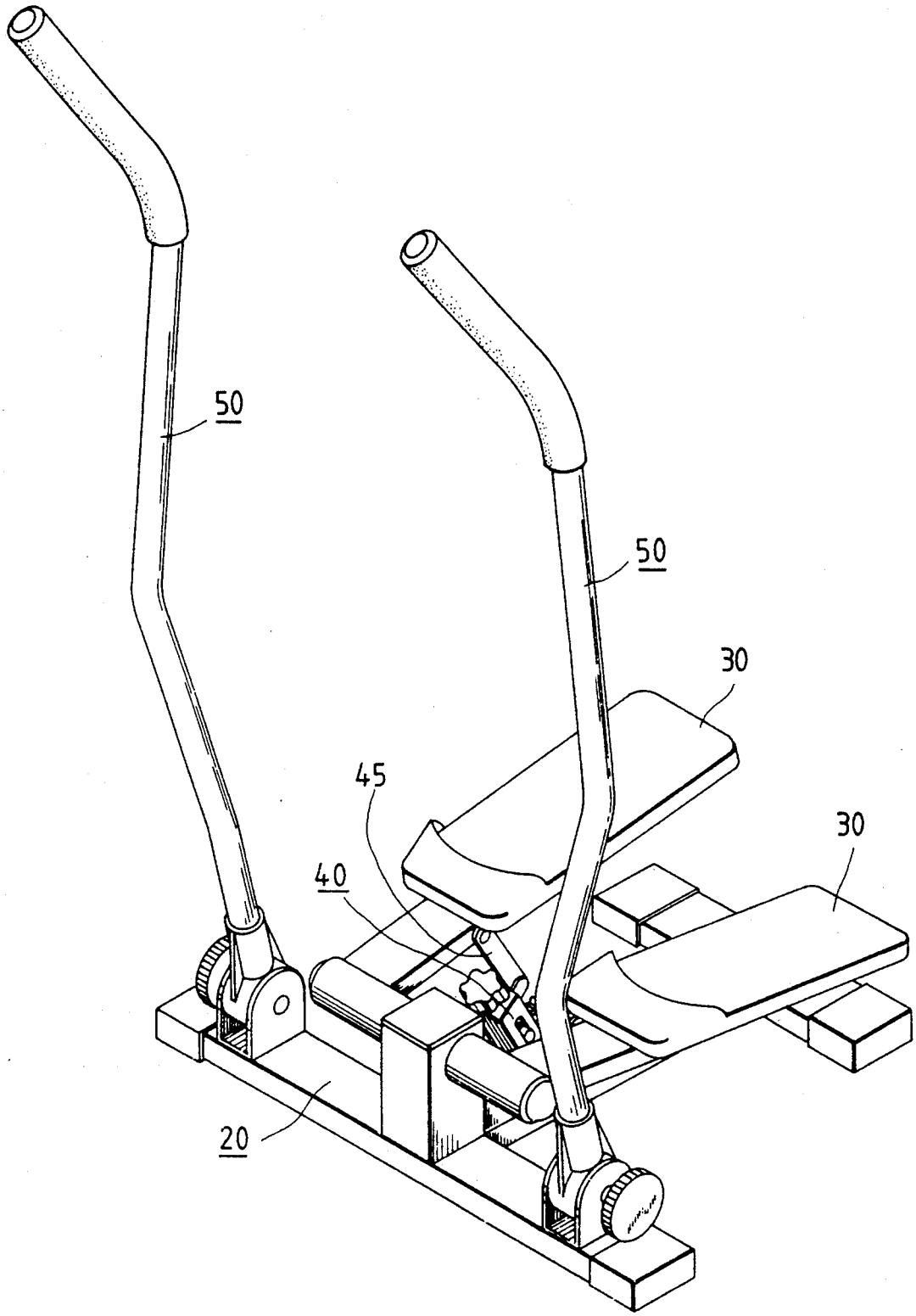
FIG. 3 shows a perspective view of the present invention in combination.

Referring to FIGS. 2–4, a gymnastic pedaling apparatus of the present invention is shown to comprise a base 20, two pedals 30, a damping adjusting device 40, and two handles 50.

The base 20 is provided at the center of front portion thereof with a projected portion 21 having a horizontally extended cylindrical body 22 located respectively at two opposite sides of the projected portion 21. The free end of the cylindrical body 22 has an inner hole 23. The front portion of the base 20 is provided respectively at both ends thereof with a U-shaped pivot lug 24 while the rear portion of the base 20 is provided at the center thereof with a U-shaped lug 25. Located respectively at the predetermined positions in the middle portion of the base 20 are four fastening holes 26.

Each of the two pedals 30 has one end provided with a treading portion 31 and has another end provided with a pivoting sleeve 32 dimensioned to fit over the cylindrical body 22 of the projected portion 21 of the base 20. The coupling of the pivoting sleeve 32 and the cylindrical body 22 is further secured by means of a fastening element 33 which engages the inner hole 23 of the cylindrical body 22. The pedals 30 are capable of moving upwards and downwards. The two pedals 30 are further provided respectively with a round hole 34 located at a predetermined position of the two sides opposite to each other.

The damping adjusting device 40 is mounted securely on the base 20 and is composed of two bottom frames 41 of an L-shaped construction, an adjusting frame 42, two connecting rods 45, a guide member 46, an adjusting threaded rod 47, and a hydraulic cylinder 48. Each of the two bottom frames 41 is provided at the horizontal surface thereof with two identical circular holes 412 to receive two fastening elements 414, which engage respectively the fastening holes 26 of the base 20. Each of the two bottom frames 41 is further provided at the vertical surface thereof with a through hole 416 furnished with a bushing 418 incapable of turning in relation to the through hole 416. The adjusting frame 42 comprises a cylindrical body 43 on which a support body 44 is mounted. The support body 44 is of a hollow rectangular construction and is provided with an elongate slot 442 located respectively in two side surfaces along the longitudinal axis of the support body 44. In addition, the support body 44 is further provided with two round holes 444 and 446, which are located respectively in two side surfaces along the short axis of the support body 44. Both ends of the cylindrical body 43 are provided respectively with a square protuberance 432 which is provided axially a threaded hole 434. The both ends of the cylindrical body 43 of the adjusting frame 42 are fitted into the bushings 418 in a manner that the adjusting frame 42 is capable of rotating along the axis of the bushing 418. Each of the two connecting rods 45 comprises a lower connection rod 451 and an upper connection rod 452. The lower connection rod 451 has one end provided with a square slot 453 corresponding in size and location to the square protuberance 432 of the cylindrical body 43. Therefore, the square protuberance 432 of the cylindrical body 43 can be fitted into the square slot 453 of the lower connection rod 451. The two lower connection rods 451 are arranged symmetrically to form an angle of 180 degrees. The lower connection rod 451 has another end that is pivoted to one end of the upper connection rod 452 by means of a pivot pin 454. Another end of the upper connection rod 452 is pivoted to the round hole 34 of the pedal 30 by means of a pivoting element 455. The guide member 46 of cylindrical construction is fitted into the elongate slot 442 of the support body 44 of the adjusting frame 42 and is provided at the center of its outer circumference with an inner threaded hole 462 provided with two bushings 464. The adjusting rod 47 has one end provided with a rotating knob 472 and has another end that passes through the round hole 444 of the support body 44 to mesh with the inner threaded hole 462 of the guide member 46 before finally pivoting to the round hole 446 of the support body 44. The hydraulic cylinder 48 has one end provided with a U-shaped pivot lug 482, which is attached to the two bushings 464 of the guide member 46. The hydraulic cylinder 48 has another end that is pivoted to the pivot lug 25 of the base 20. Therefore, upon completing a downward movement, the pedals 30 can activate, via the connecting rods 45, a corresponding damping effect generated by the adjusting frame 42.

Each of the two handles 50 of a predetermined shape has one end provided with a hand grip 51 and has another end provided with a rotating sleeve 52 having an inner hole 53 surrounded by a plurality of receiving cells 54 into which a plurality of brake shoes 55 are inserted. Each of the two handles 50 is fastened to the pivot lug 24 of the base 20 by means of the rotating sleeve 52. A pivoting element 56 having an adjusting knob 57 is used to secure the fastening of the handle 50 to the base 20 by letting the pivoting element 56 to engage the inner hole 53 of the rotating sleeve 50. The handles 50 can be moved forward and backward, thereby allowing a user of the gymnastic pedaling apparatus of the present invention to do an exercise similar to a rowing. If the user desires to make a greater effort to row the handles 50, he or she may rotate the adjusting knob 57 to increase the mechanical friction between the brake shoes 55 of the rotating sleeve 52 and the pivot lugs 24 of the base 20.

The mechanism of the motion transmission of the component parts of the present invention is illustrated in FIG. 4. As soon as the pedals 30 are made to move upwards and downwards, the connecting rods 45 are activated to cause the adjusting frame 42 to undertake an angular displacement. Therefore, the piston rod 484 of the hydraulic cylinder 48 generates a forward or a backward damping effect of motion. The extent of such damping effect can be adjusted by means of the rotating knob 472 of the adjusting frame 42. In other words, when the guide member 46 of the adjusting frame 42 is situated at the bottom end of the elongate slot 442, the effect of damping is smaller in view of the fact that the resistance of lever of force of the hydraulic cylinder 48 is shorter. On the other hand, when the guide member 46 is situated at the upper end of the elongate slot 442, as shown by the broken lines in FIG. 4, the effect of damping is greater, due to the fact that the resistance of lever of force of the hydraulic cylinder 48 is longer. The magnitude of damping effect can be adjusted by turning the rotating knob 472 of the adjusting threaded rod 47, which in turn triggers the guide 46 to move upwards and downwards, so as to alter the length of the resistance of lever of force of the hydraulic cylinder 48.

In conclusion, the gymnastic pedaling apparatus of the present invention has several advantages over the prior art, which are elucidated hereinafter.

In the present invention, the damping effect is attained by means of only one hydraulic cylinder instead of two hydraulic cylinders that are used in the prior art. It is therefore clear and obvious that the material cost of making the gymnastic pedaling apparatus of the present invention is relatively lower.

The gymnastic pedaling apparatus of the present invention is constructed in such a manner that its damping effect can be adjusted even when the apparatus is in action.

The gymnastic pedaling apparatus of the present invention affords not only a simulated hiking exercise but also a simulated rowing exercise.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the hereinafter appended claims.

What is claimed is:

1. A gymnastic pedaling apparatus comprising a base provided thereon with a projected portion having a horizontally arranged cylindrical body of a length extending beyond two opposite sides of said projected portion, said apparatus further comprising two pedals pivoted respectively to said cylindrical body of said projected portion, said apparatus still further comprising a damping adjusting device mounted on said base; wherein said damping adjusting device is characterized in that said damping adjusting device comprises:

(a) two bottom frames, fastened to said base, said two bottom frames rotatably supporting an adjusting frame provided with two lower connection rods arranged oppositely thereof with each of said two lower connection rods having one end pivoted with one end of an upper connection rod pivoted with one of said two pedals, said adjusting frame further provided with an adjusting threaded rod and a guide member; and (b) a hydraulic cylinder having one end fastened pivotally to said base and another end pivoted with said guide member engaging said adjusting threaded rod capable of rotating to activate said hydraulic cylinder via said guide member so as to alter resistance of said hydraulic cylinder.

2. The gymnastic pedaling apparatus of claim 1 wherein said base is pivotally provided with two handles, each of which is capable of making a forward and backward movement and each said handle is provided with an adjusting knob to regulate said forward and backward movement.

3. The gymnastic pedaling apparatus of claim 1 wherein said hydraulic cylinder has a piston rod with one end provided with a U-shaped pivot lug fastened to a bushing of said guide member.

* * * * *